United States Patent [19]

Pontikas

[11] Patent Number: 4,809,755

[45] Date of Patent: Mar. 7, 1989

[54] APPARATUS AND METHOD FOR FORMING A VARIETY OF WOODWORKING JOINTS

[76] Inventor: James T. Pontikas, 533 Moore Ave., Baden, Pa. 15005

[21] Appl. No.: 232,304

[22] Filed: Aug. 15, 1988

[51] Int. Cl.[4] ..... B27M 3/00

[52] U.S. Cl. ..... 144/372; 144/85; 144/87; 144/144.5 R; 144/145 A

[58] Field of Search ..... 144/82, 83, 85, 87, 144/134 R, 134 A, 137, 144 S, 145 R, 145 A, 371, 372

[56] References Cited

U.S. PATENT DOCUMENTS

| | | | |
|---|---|---|---|
| 4,373,562 | 2/1983 | Vernon | 144/144.5 |
| 4,405,004 | 9/1983 | Dicke | 144/144.5 |
| 4,428,408 | 1/1984 | Grisley | 144/144.5 |

*Primary Examiner*—W. Donald Bray

*Attorney, Agent, or Firm*—Price & Raynovich, Ltd.

[57] ABSTRACT

Apparatus and a method for forming various types of woodworking joints on workpieces are provided. A series of templates are provided that, when utilized with the appropriate cutting bit for a router produce the desired joint configuration. The router is mounted below a support platform with the cutting bit of the router extending upwardly through a central aperture in the support platform. A guide bushing fixed to the support platform surrounds the cutter bit. A selected template is fixed to fence posts that extend upwardly from the template. The fence posts secure a fence to the template. The fence has clamps that clamp a workpiece to the fence so that the workpiece can be positioned over the edge patterns on the template. Handles are secured to the fence posts and the fence. With the workpiece in a proper position over the edge patterns on the template, the template, the fence posts, the fence, the handles, and the workpiece are moved as a unit over the router support platform with the edge pattern of the template in contact with the guide bushing surrounding the router cutting bit. The appropriate joint configuration is thereby cut into the workpiece. By changing the template or by changing the angle of the fence or the position of the workpiece, various joint configurations can be produced. Among the joint configurations that can be produced are through dovetail joints, angled dovetail joints, blind dovetail joints, box joints, splined joints, mock dovetail joints, and angled box joints.

20 Claims, 8 Drawing Sheets

APPARATUS AND METHOD FOR FORMING A VARIETY OF WOODWORKING JOINTS

BACKGROUND OF THE INVENTION

1. Field of the Invention

This invention relates to apparatus and a method for forming a variety of woodworking joints in adjacent workpieces which are to be joined. Some of the joints that may be formed by the apparatus and method of this invention are dovetail joints, box joints, blind dovetail joints, splined joints, and mock dovetail joints.

2. Description of the Prior Art

It is well-known to provide various types of templates and jigs to be utilized with woodworking cutting tools in order to cut joint configurations into adjoining workpieces to thereby join the adjoining workpieces. U.S. Pat. No. 3,109,466, U.S. Pat. No. 4,168,730, U.S. Pat. No. 4,407,344, and U.S. Pat. No. 4,428,408 all disclose examples of various templates and jigs which may be utilized to pass a cutting tool, such as router, over the template to guide the cutting tool in order to form a woodworking joint.

U.S. Pat. No. 3,272,244, U.S. Pat. No. 3,606,916, British Pat. No. 531,302, and German Pat. No. 723,183 all show examples of complete machines utilized to form a specific type of woodworking joint. In these machines, a cutting tool protrudes upwardly and follows a guide or template to produce a desired woodworking joint. U.S. Pat. No. 4,542,776 discloses a separate apparatus for producing splined corner joints.

While the prior art suggests various arrangements for making one type of joint in a specific fashion, I have found that it is desirable to be able to form a variety of woodworking joints by utilizing a common apparatus which requires only different templates and a rearrangement of the workpiece relative to the templates to obtain a large number of different joint configurations. A publication entitled "The Router, Revised Edition" by Robert R. Rosendahl published in 1986 shows at pages 55–99, inclusive, various methods of utilizing a router to form certain joints and other woodworking configurations. This publication does not, however, disclose a comprehensive scheme for forming a variety of woodworking joints with a router.

There is a need in the woodworking art for providing a simple, inexpensive apparatus for forming a variety of woodworking joints and a unique method of utilizing such an apparatus.

SUMMARY OF THE INVENTION

In accordance with the present invention there is provided a tool kit for forming various types of types of joints to connect adjoining wooden members. The tool kit comprises a horizontally positioned router support platform having a central aperture and having means to secure the housing of the router to the support platform so that the cutting bit of the router extends upwardly through the central aperture. A guide means surrounds the router bit for guiding a template. A template is provided having edge patterns for forming the desired type of joint configuration. Fence posts are securable to each end of the template to support a workpiece fence. A workpiece fence is securable to the fence posts. Clamps are provided to clamp the workpiece to the fence in a position so that the portion of the workpiece upon which the joint is to be formed is positioned relative to the template so that the workpiece position and the configuration of the template control the type of joint that is formed on the workpiece. The template, the fence posts, the guide fence, and the workpiece are all movable as a unit over the router support platform so that the template is guided by the guide means to form the desired joint configurations in the workpiece.

Further, in accordance with the present invention, there is provided a woodworking tool kit for forming various types of joints to connect adjoining members. The tool kit comprises a router support platform constructed and arranged to be supported in a horizontal position on a woodworking bench. A router support platform has a central aperture through it so that the cutting bit of the router protrudes upwardly through the central aperture. The support platform also has means to fix the housing of the router to the support platform and below the platform. Guide means is provided for the router cutting bit. The guide means is secured to the upper surface of the support platform so that the cutter bit rotates relative to the guide means. A template is provided that has edge patterns for forming the desired type of joint configuration. Fence posts are removably securable to each end of the template to support a workpiece fence. The workpiece fence is removably securable to the fence posts so that the fence may be positioned at various angles relative to the template, including an angle of 90°. Clamps are provided to clamp the workpiece to the fence in a position so that the portion of the workpiece, upon which the joint is to be formed, is brought into position on the template. The workpiece position on the template and the configuration of the template control the type of joint formed on tthe workpiece. Handles are secured to each of the fence posts so that the template, fence posts, and the guide fence with the workpiece attached may be moved as a unit over the router support platform so that that template is guided by the guide means to form the desired joint configurations in the workpiece.

Still further, in accordance with the present invention, there is provided a method of forming a selected type of joint to connect adjoining wooden members. The method comprises fixing a router below a horizontal support platform so that the cutting bit of the router extends upwardly through an aperture in the platform and through a cylindrical guide means fixed to the platform. A cutting bit is selected for the router which has a configuration compatible with the configuration of the selected type of joint. A template is selected that has edge patterns for forming the selected type of joint configuration. A workpiece, upon which the selected joint configuration is to be formed, is temporarily fastened to the template. The template is slid over the support platform with the template edge pattern in contact with the guide means so that the router cutting bit cuts the desired joint configuration into the workpiece. Thereafter, the workpiece is removed from the template.

Accordingly, the principal object of the present invention is to provide apparatus and a method for forming various types of joints to connect adjoining wooden members.

Another object of the present invention is to provide a simple, inexpensive tool kit for forming various types of joints in adjoining wooden members.

A further object of the present invention is to provide the components of a tool kit which cooperate with a router to form various selected woodworking joints.

These and other objects of the present invention will be more completely disclosed and described in the following specification, the accompanying drawings, and the appended claims.

DESCRIPTION OF THE PREFERRED EMBODIMENTS

Figure 1:
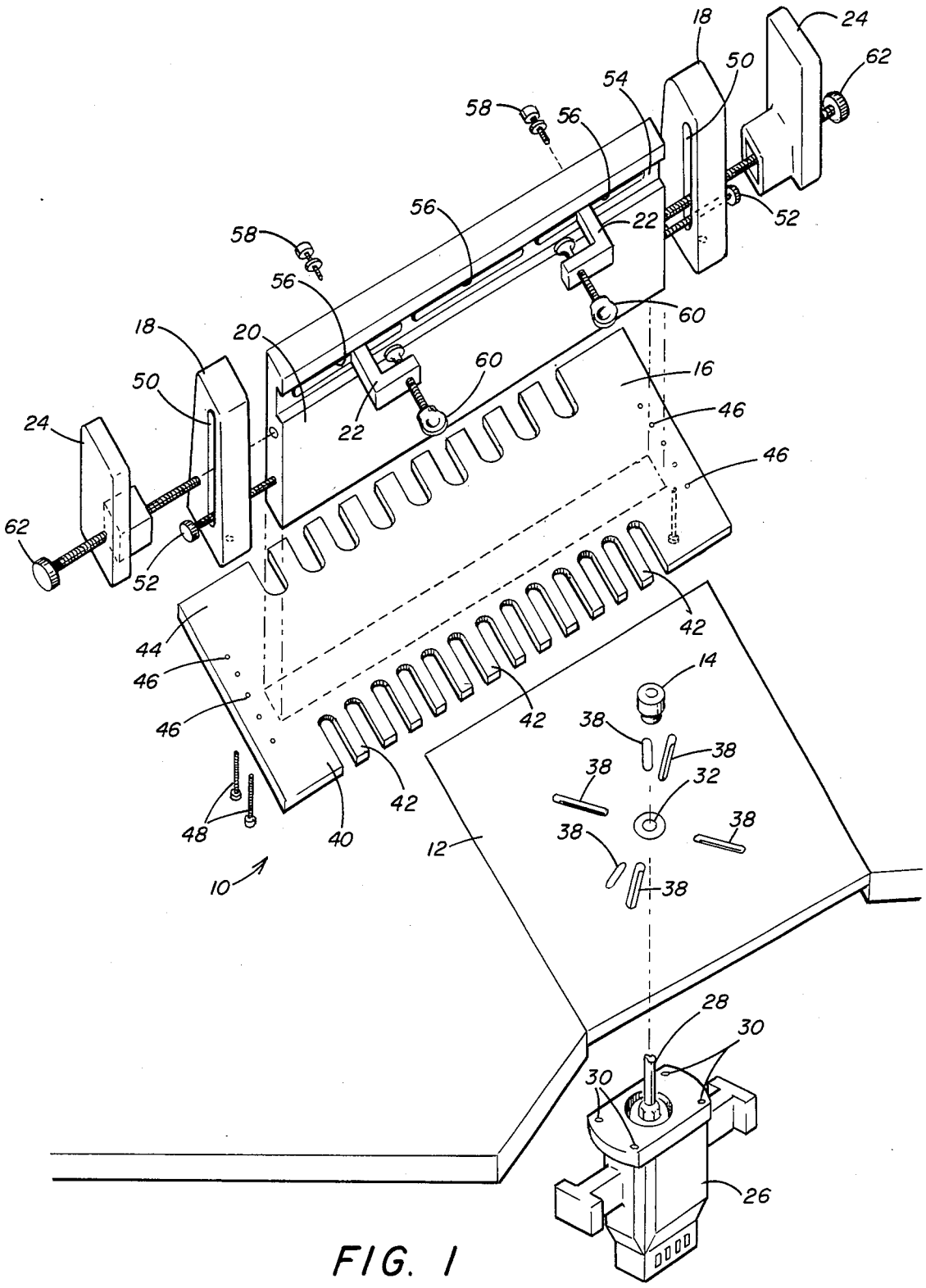
FIG. 1 is an exploded, perspective view of the apparatus of the present invention.
Figure 2:
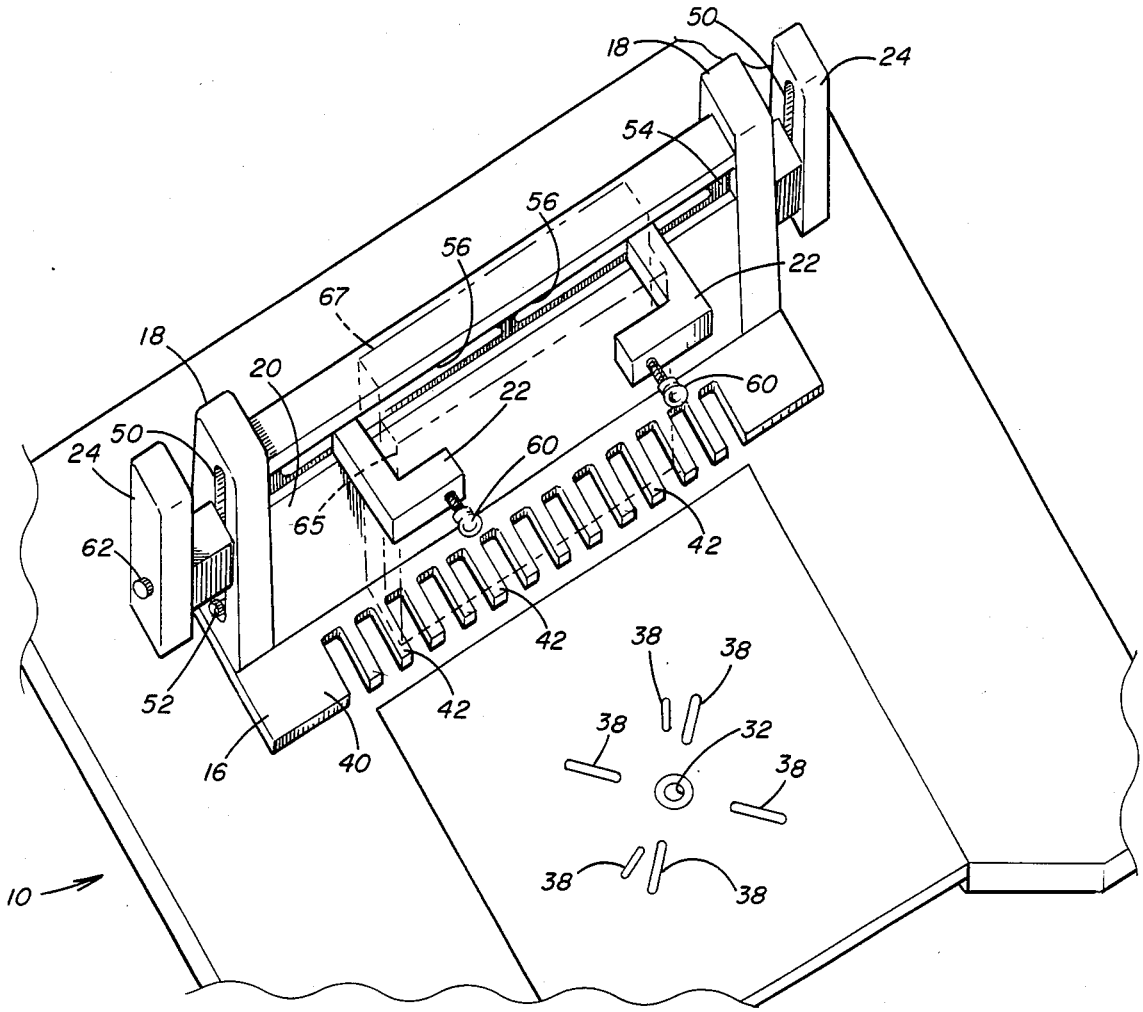
FIG. 2 is a perspective view similar to FIG. 1 wherein the parts have been assembled.

Referring to the drawings, and particularly to FIGS. 1 and 2, there is a tool kit indicated generally at 10 comprising a router support platform 12, a guide bushing 14, a template 16, fence posts 18, a fence 20, clamps 22, and handles 24.

Figure 4:
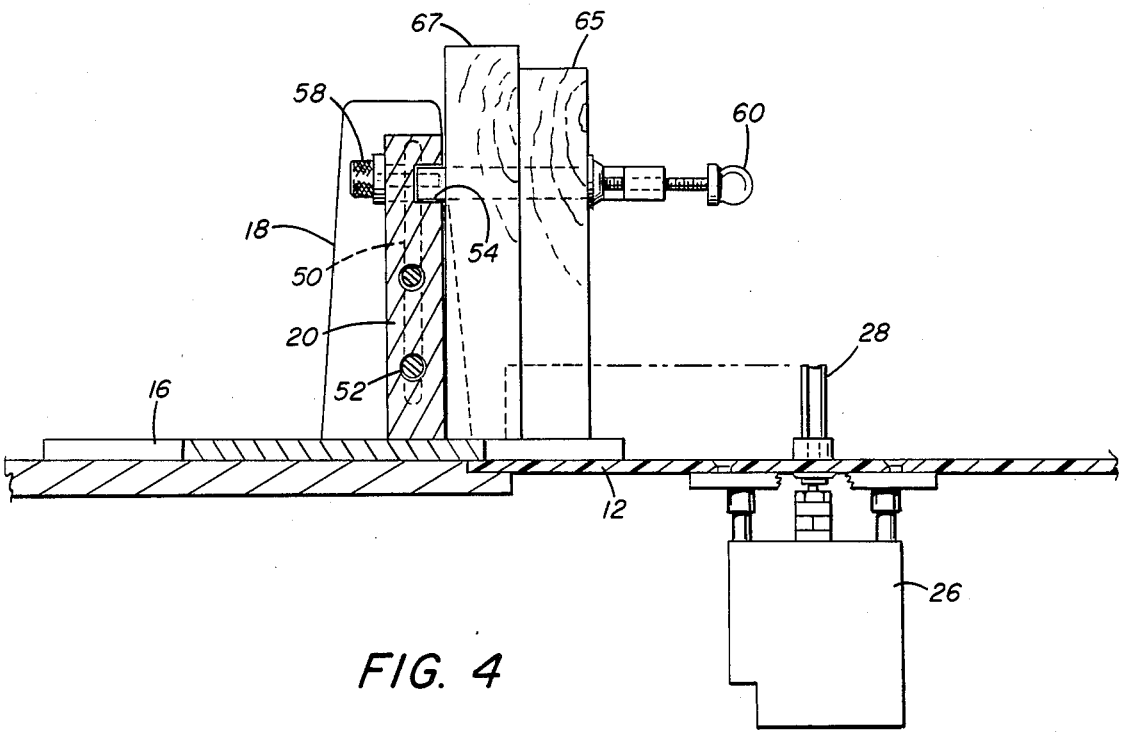
FIG. 4 is a sectional side elevation taken along line 4—4 of FIG. 3.
Figure 3:
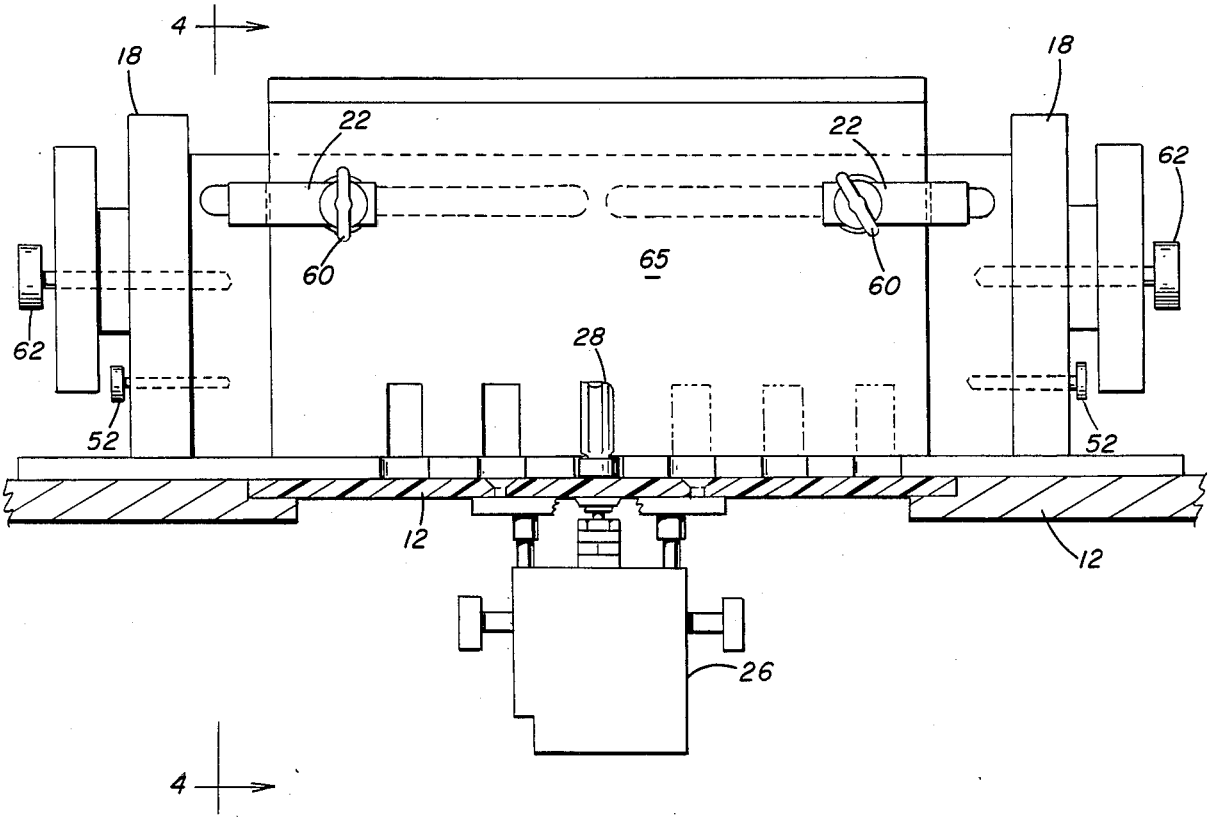
FIG. 3 is a front elevational view partially in section of the apparatus of the present invention.

As seen in FIGS. 1, 3, and 4, a router body 26 having a cutter bit 28 extending therefrom, has tapped holes 30 formed in the body. The router body 26 is positioned so that the cutter bit 28 extends upwardly through a central aperture 32 formed in support platform 12. The support platform 12 is preferably made from phenolic plastic approximately one-quarter (¼) inch thick. It may also be made of aluminum or steel.

Figure 5:
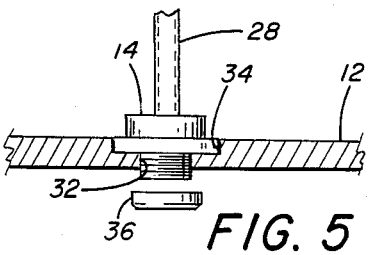
FIG. 5 is a detailed view of the router guide bushing installed in the router support platform.

As best seen in FIG. 5, the central aperture 32 of support platform 12 has a circular recessed portion 34 in the upper surface of the platform. The recessed portion 34 receives the guide bushing 14 which is held in place by collar 36 threaded on to guide bushing 14. As shown in FIG. 5, the cutter bit 28 extends upwardly through the guide bushing 14.

Also formed in the support platform 12 are radially extending countersunk slots 38 which permit the router housing 26 to be secured to the platform 12 with countersunk headed machine screws (not shown) that go through slots 38 and into the router housing. There are a plurality of slots 38 provided so that various different types of router housings may be secured to the platform 12.

Figure 8:
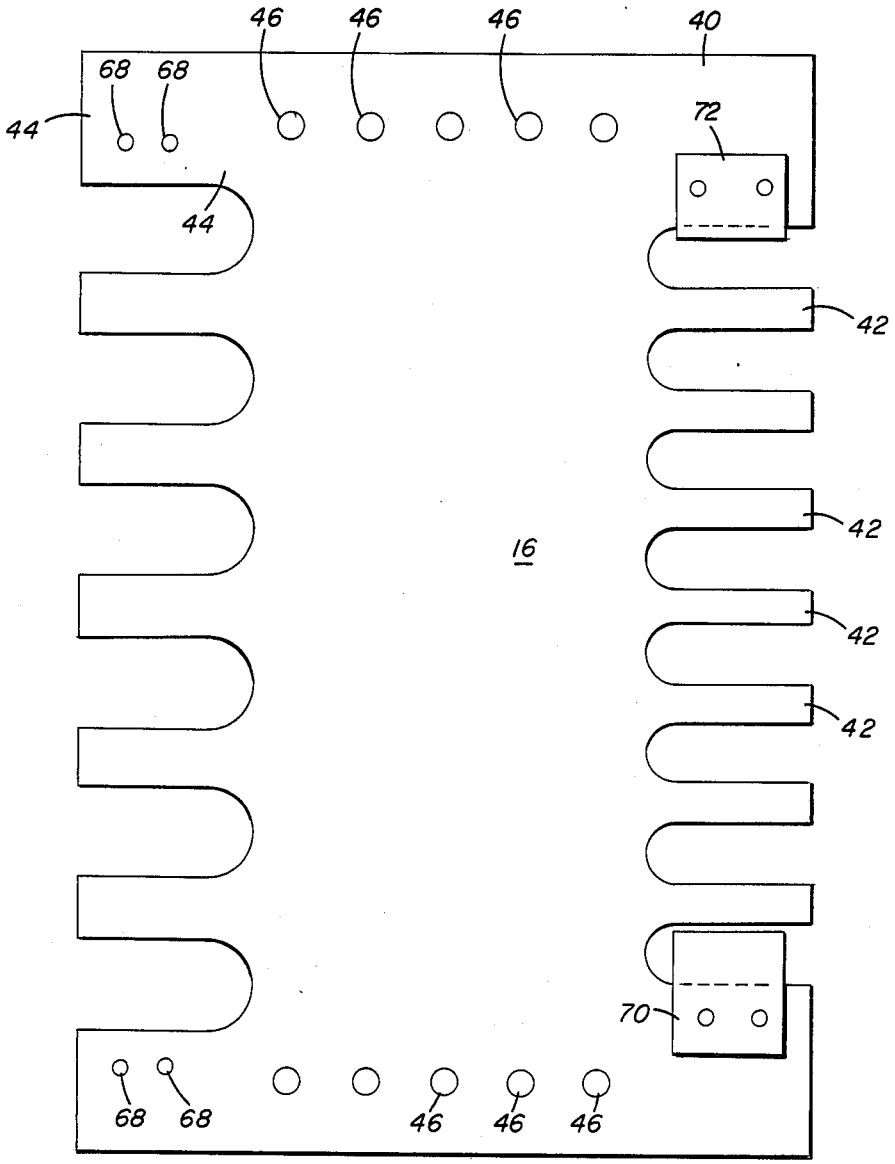
FIG. 8 is a top plan view of a template for forming box joints.

Referring again to FIGS. 1 and 2, the template 16 has an edge pattern 40 consisting of a plurality of fingers or lands 42 separated by grooved recesses in the edge of template 16. A second edge pattern 44 of a different size is also provided on template 16. Referring to FIGS. 1, 2, and 8, it will be seen that template 16 has a plurality of countersunk holes 46 formed along each end of the template 16. The countersunk holes permit the template to be secured to fence posts 18 by means of machine screws 48 that have countersunk heads. As viewed in FIGS. 1 and 2, the bottom of the template 16 will be perfectly smooth since the machine screw heads of screws 48 recess into the countersunk holes 46.

There are multiple holes 46 formed in the ends of template 16 so that the fence posts 18 may be positioned in any one of a number of positions between the sides of template 16. The posts 18 are identical to each other and each have off-center slots 50 formed vertically in them. The off-center slots permit the fence 20 to be positioned in a greater number of positions as will be described. Bolts 52 secure fence 20 to fence posts 18 although, in some cases, the bolts 52 may not be utilized.

The fence 20 is of generally rectangular configuration and is supported in position by the fence posts 18. The fence 20 has a longitudinally extending groove 54 within which are formed slots 56 that extend through the fence 20. Clamps 22 extend into the groove 54 in fence 20 and are retained in place by bolts 58 that are positioned through the slots 56 and threaded into clamps 22. Each of the clamps 22 has a clamp bolt 60 that may be rotated by hand to clamp a workpiece against the fence in a manner to be described. The handles 24 are secured to the fence posts 18 and to the fence 20 by handle bolts 62 that are threaded into the fence 20.

Figure 7:
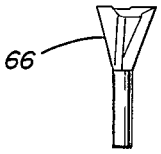
FIG. 7 is a side elevational view of a conical cutter bit.
Figure 6:
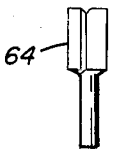
FIG. 6 is a side elevational view of a cylindrical cutter bit.

As shown in the assembled condition in FIG. 2, the fence 20 is in a vertical position and a workpiece 65 is shown in phantom lines with a back-up block 67 behind it. The workpiece 65 and the back-up block 67 are clamped to the fence 20 by means of clamps 22 by tightening clamp bolts 60. The template 16, the fence posts 18, and the handles 24 may be picked up as a unit. The workpiece 65 clamped to fence 20 by clamps 22 goes with that unit. The entire unit may be slid over the router support platform 12 so that the guide bushing 14 that protrudes above the support platform 12 may guide the template 16 by entering the various spaces in edge pattern 40 on template 16. The cutter bit 28 of the router cuts into the workpiece 65. The cutter bit 28 may be of either a cylindrical configuration 64 as shown in FIG. 6 or of a conical configuration 66 as shown in FIG. 7. When selecting the appropriate template and cutter bit and positioning the workpiece as necessary, various joint configurations may be formed as will be described.

Figure 9:
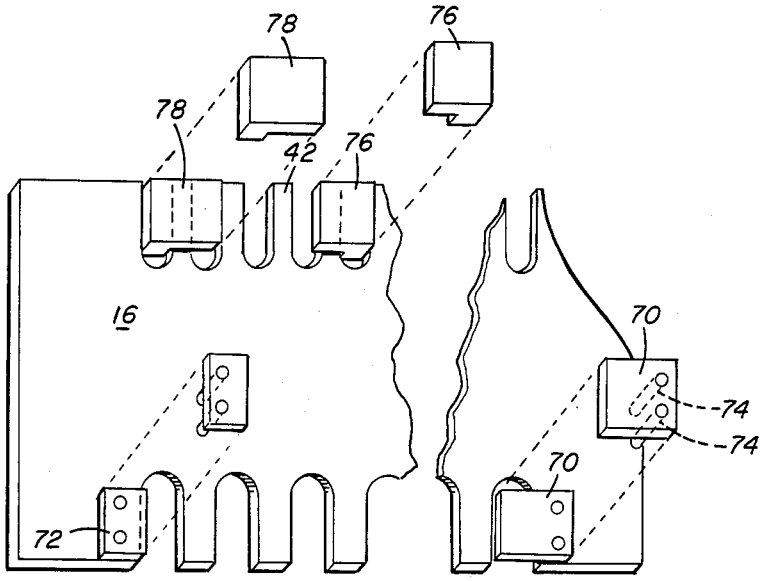
FIG. 9 is a partial view of the template of FIG. 8 showing stops associated with it.

Referring again to FIG. 8, there are holes 68 formed near the edge of template 16. The holes 68 are designed to receive stops 70 and 72 which may also be seen in FIG. 9. Stop 70 is enlarged and covers an entire space between lands on the edge pattern of template 16. Stop 72 is smaller and covers only one-half (½) the space between lands on the edge pattern of template 16. The stops 70 and 72 each have prongs 74 which enter into the holes 68 on template 16. Another form of stop block 76 and 78 is shown in FIG. 9. These stops are formed with a horizontal portion and a deeper end portion that enter between the lands 42 on the edge pattern of template 16. Both the stops 70 and 72 and the blocks 76 and 78 may be utilized to position the workpiece longitudinally relative to the template before the workpiece is clamped in position onto fence 20.

Figure 10:
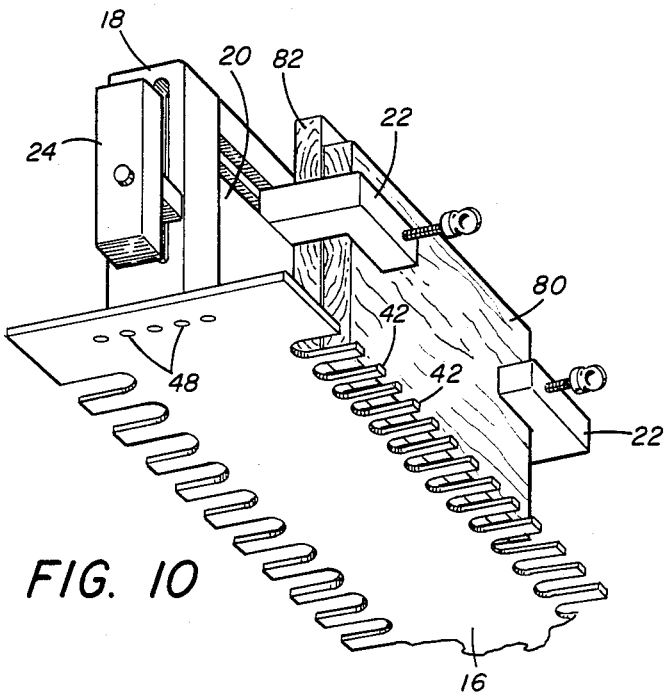
FIG. 10 is a perspective view of the template of FIG. 8 attached to the fence of the present invention and having a workpiece affixed to the fence.

As seen in FIG. 10, a workpiece 80 and a back-up block 82 are clamped to fence 20 by clamps 22. The machine screws 48 attach the fence posts 18 to the template 16 so that the fence 20 is positioned sufficiently far away from the edge of template 16 to permit the workpiece 80 to be inside the edge of template 16 and also to permit the cutter bit to pass all the way through workpiece 80 into the back-up block 82. Back-up block 82 is essentially a piece of scrap material which will be thrown away after the proper joint pattern is cut into workpiece 80.

With the configuration shown in FIG. 10, the cylindrical cutter bit 64 (FIG. 6) is positioned in the router through the guide bushing 14. The assembly of FIG. 10 is then positioned onto support platform 12 and the workpiece is moved into contact with the rotating cutter bit of router 26. The guide bushing 14 guides the template 16 and template 16 causes the cutter bit to enter into the proper areas of the workpiece 80. Because the cutting bit on most routers may be extended from the housing 26, the depth of cut of the cutting bit may be adjusted and, if necessary, several passes may be made over the guide bushing with the template to achieve the proper configuration in the workpiece 80.

Figure 13:
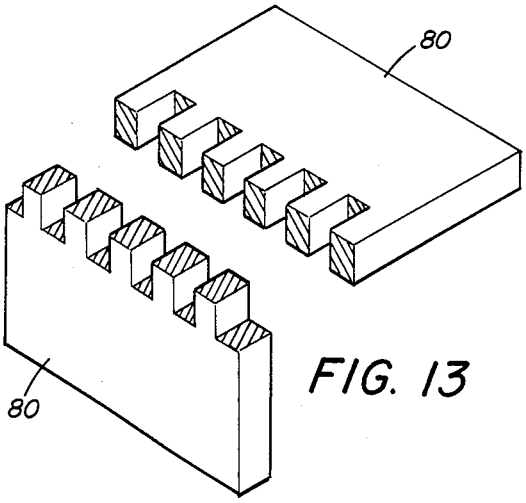
FIG. 13 shows a box joint produced with the arrangement of parts shown in FIG. 10.

The arrangement of FIG. 10 produces a box joint as shown in FIG. 13. After one-half (½) of the joint is formed, a second workpiece 80 is positioned as was the first workpiece except that the second workpiece is shifted longitudinally along the template 16 so that it matches with the first workpiece as shown in FIG. 13. As shown in FIG. 13, the lower portion of the joint has grooves at each end where as the upper portion of the joint has pins at each end. The workpiece for the second cut is shifted to coordinate the proper positioning of the pins and grooves to accommodate the first workpiece 80. The stop blocks 70, 72, 76, or 78 are utilized to properly position the workpieces longitudinally.

On template 16 (FIG. 8) two different sizes of edge patterns 40 and 44 are provided. Either side may be utilized depending upon the size of the box joint desired.

Figure 11:
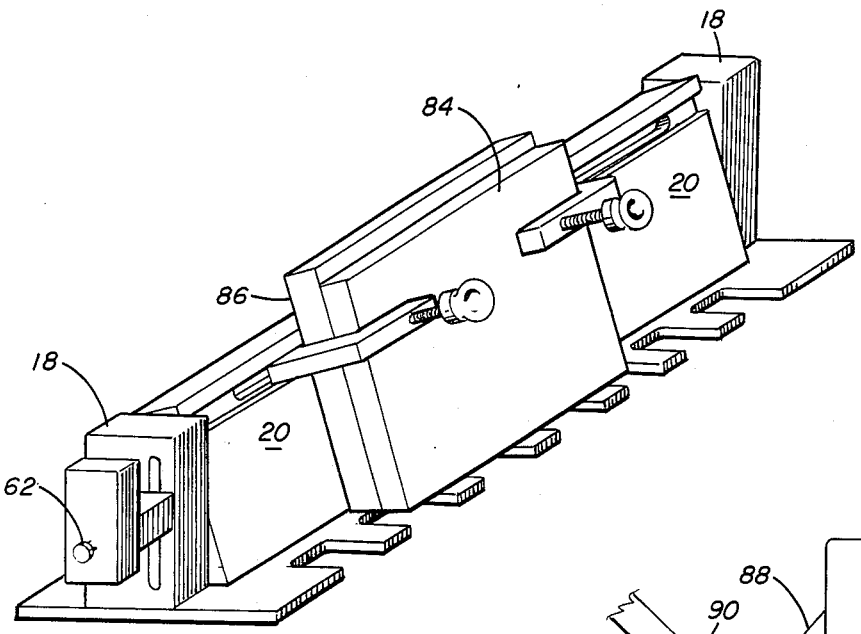
FIG. 11 is a perspective view of the same articles shown in FIG. 10 with the fence tilted at an angle to the vertical.
Figure 15:
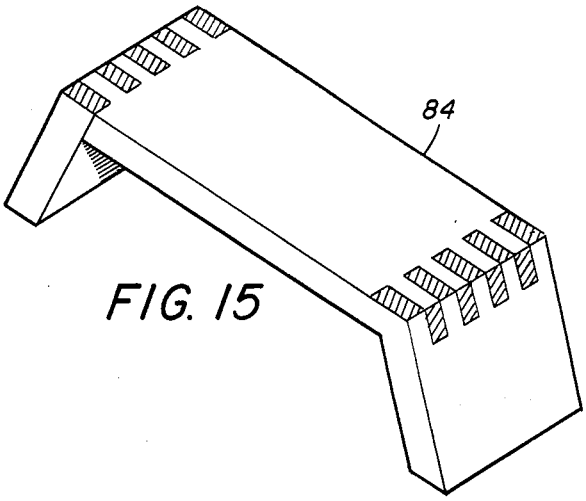
FIG. 15 shows an angled box joint made utilizing the configuration of FIG. 11.

Referring to FIG. 11, a workpiece 84 and a back-up block 86 are clamped to fence 20. In FIG. 11, fence 20 has been rotated from the vertical. In this case, bolts 52 (FIG. 1 and FIG. 2) have been omitted and the fence is connected to the fence posts 18 only with handle bolts 62. With the fence inclined to the vertical as shown in FIG. 11, an angled box joint as shown in FIG. 15 may be produced. The edges of workpiece 84 will be appropriately beveled before workpiece 84 is clamped into position on fence 20. The unit of FIG. 11 is then passed over the router cutting bit 64 which is of cylindrical configuration.

Figure 16:
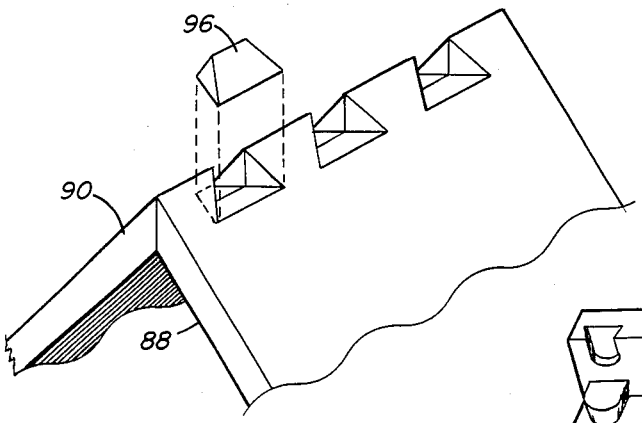
FIG. 16 shows a mock dovetail joint made utilizing the configuration of FIG. 12.
Figure 12:
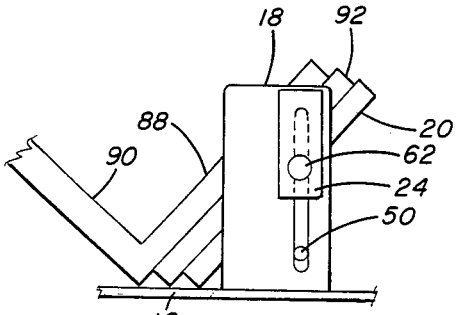
FIG. 12 shows the position of an another workpiece positioned on the fence of the present invention.
Figure 14:
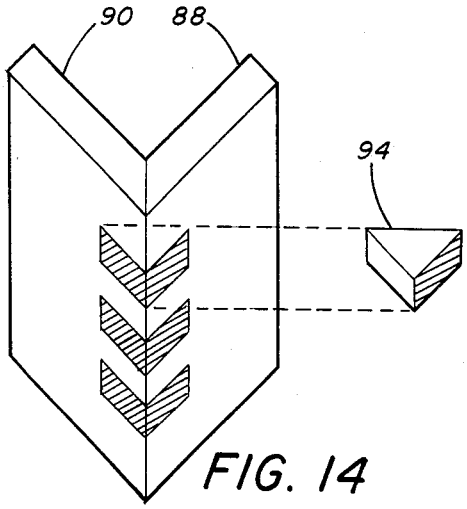
FIG. 14 shows a splined joint formed utilizing the configuration of FIG. 12.

FIG. 12 shows a diagrammatic view of the tilted or angled fence 20 which is held in place on the fence posts 18 by handle bolts 62. As seen in FIG. 12, a splined joint as shown in FIG. 14 or a mock dovetail joint as shown in FIG. 16 may be formed. In the configuration of FIG. 12, workpieces 88 and 90 are glued together at right angles. The back-up block 92 and the workpiece 88 are clamped to fence 20 which is at a 45° angle to the horizontal as shown in FIG. 12. The corner of the intersection of workpieces 88 and 90 is positioned over the edge pattern 40 of template 16. When a cylindrical router cutter bit 64 is utilized and the template is passed over bushing 14 grooves are formed to provide the splined joint shown in FIG. 14. As seen in FIG. 14, splines 94 are cut and positioned in the grooves to provide the splined corner joint.

If the arrangement of FIG. 12 is utilized with a conical cutter bit 66 as shown in FIG. 7, a mock dovetail joint such as shown in FIG. 16 is formed. The mock dovetail pieces 96 are positioned in the grooves to form the joint.

Figure 18:
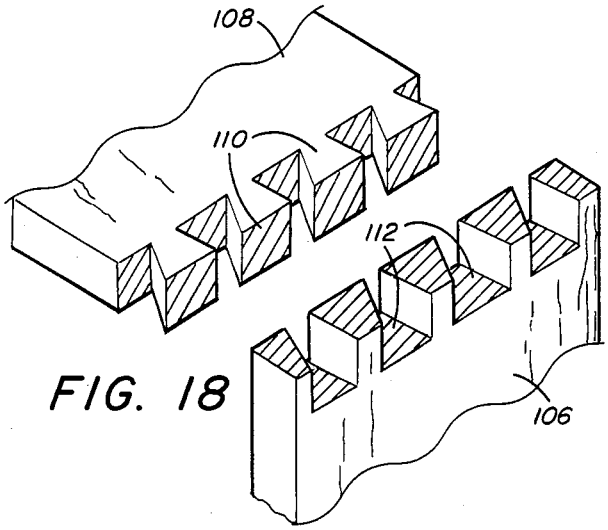
FIG. 18 shows a dovetail joint formed utilizing the template of FIG. 17 and the arrangement shown in FIGS. 1 and 2.
Figure 17:
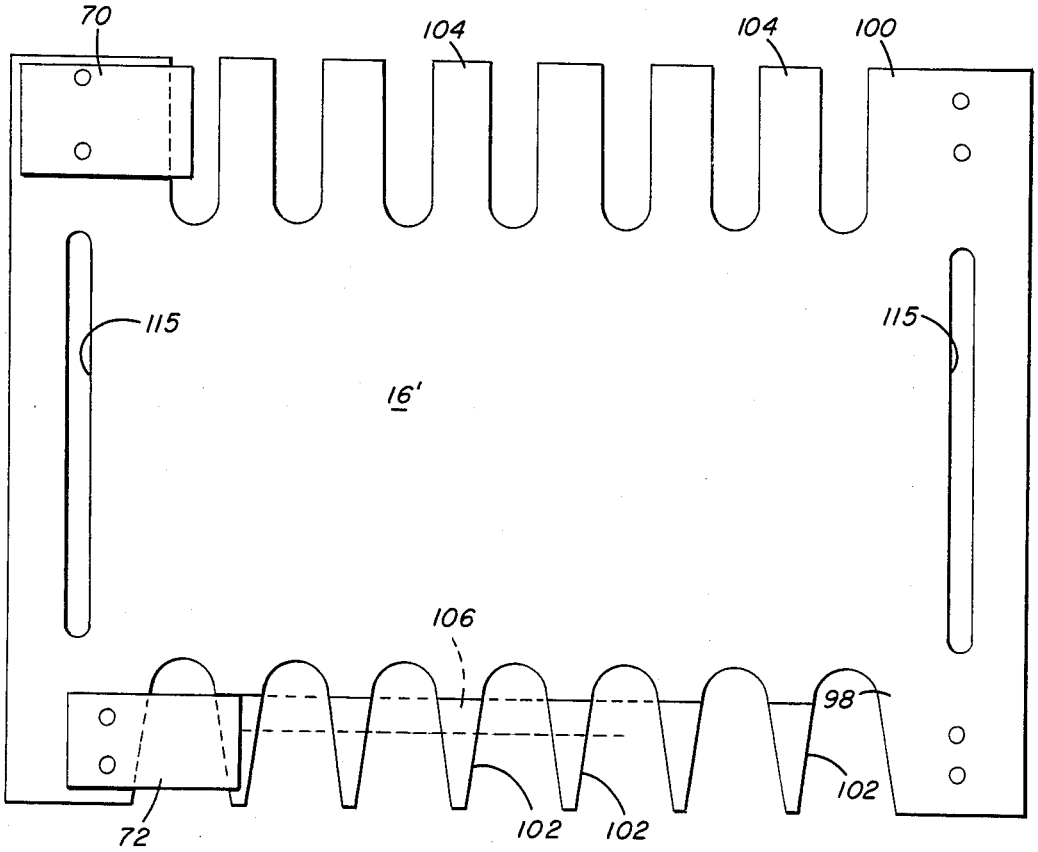
FIG. 17 shows a template having edge patterns utilized to form dovetail joints.

Referring now to FIG. 17, there is shown another form of template 16' which is utilized to make through dovetail joints. The template 16' has a grooe edge pattern 98 on one edge which is utilized to form the grooves of the joint and a pin edge pattern 100 on the opposite edge which is utilized to form the pins of the joints. The edge pattern 98 has lands 102 whose sides diverge at an angle as seen in FIG. 17. The edge pattern 100 has lands 104 which are parallel to each other. Referring to FIGS. 17 and 18, a workpiece 106 is positioned over the groove edge pattern 98. The positioning of the workpiece 106 will be similar to the position of workpiece 80 in FIG. 10 but rather than having the template 16 of FIG. 10, in order to provide dovetail joints the template 16' will be utilized. With the workpiece 106 clamped to the fence 20 and with a cylindrical cutter bit 64 in the router, the template 16' is moved along guide bushing 14 over the router support platform 12. The resulting pattern on workpiece 106 produces the grooves 112 of the dovetail joint as shown in FIG. 18.

Figure 19:
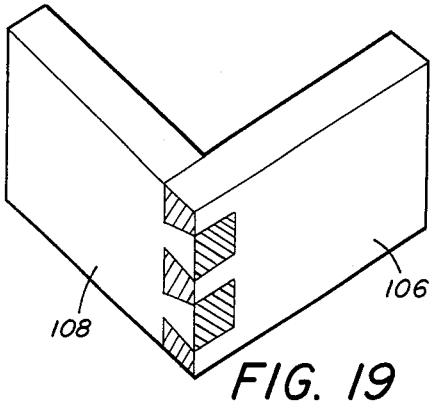
FIG. 19 shows an assembled joint similar to that shown in FIG. 18.

When the workpiece 108 is positioned over the edge pattern 100 of template 16' and a conical cutter bit 66 (FIG. 7) is utilized in the router, the pins 110 of FIG. 18 are formed. It should be noted that the angle of divergence of the conical cutter but 66 is equal to the angle at which the lands 106 diverge in edge pattern 98. This ensures that the two parts of the joint will match. A joint such as shown in FIG. 18 is shown in the assembled position in FIG. 19. Again, the stops 70 and 72 are utilized to position the workpieces 106 and 108 longitudinally on template 16' and to coordinate the positions of the pins 110 and grooves 112 formed on the workpiece.

Figure 20:
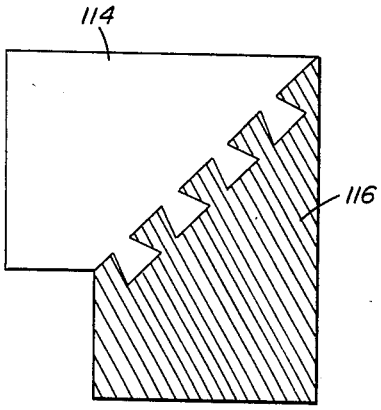
FIG. 20 shows a dovetail joint for connecting the edges of a frame.

As seen in FIG. 20, there is a mitered angled dovetail joint formed from workpieces 114 and 116. This joint may be produced by utilizing edge pattern 100 on template 16' with a conical cutter bit 66 in the router to produce workpiece 114. Workpiece 116 is formed on edge pattern 98 utilizing a cylindrical cutter bit. The workpieces 114 and 116 interfit with each other to form the angled joint. It should be noted that in the template 16′ of FIG. 17, rather than have holes 46 along the end as shown on template 16, there are countersunk slots 115 along each end of the template 16′. These countersunk slots 115 serve the same purpose as the multiple holes 46 shown in template 16.

Figure 21:
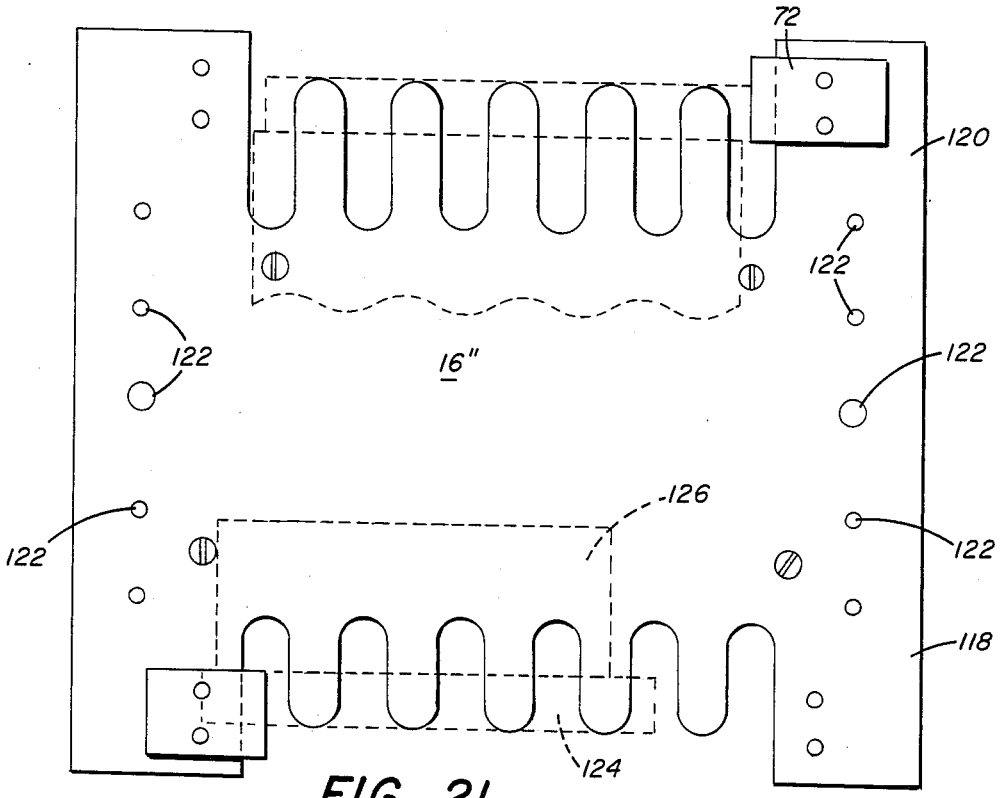
FIG. 21 shows the top plan view of a template having edge patterns for producing blind dovetail joints.

Referring now to FIG. 21, there is shown a template 16″ that is utilized for forming blind dovetail joints. The templates 16, 16′, and 16″ are all preferably formed from aluminum but may also be formed of plastic or of plywood. The template 16″ has an edge pattern 118 formed along one edge and an edge pattern 120 formed along the outer edge. Holes 122 are formed along each end of the template 16′ to receive machine screws 48 to attach the template 16″ to the fence posts 18.

When utilizing template 16″ of FIG. 21, workpiece 124 and workpiece 126 which form a single joint are cut simultaneously. As seen in both FIGS. 21 and 22, workpiece 124 is positioned parallel to fence 20 and its edge overlies the edge pattern 118. Workpiece 126 is positioned parallel to template 16″ and abuts workpiece 124. Workpiece 126 is held firmly against template 16″ by means of a hold down strip 128 that crosses over workpiece 126 and has posts 130 into which are threaded machine screws (not shown) from below template 16′ through the holes 122.

Figure 22:
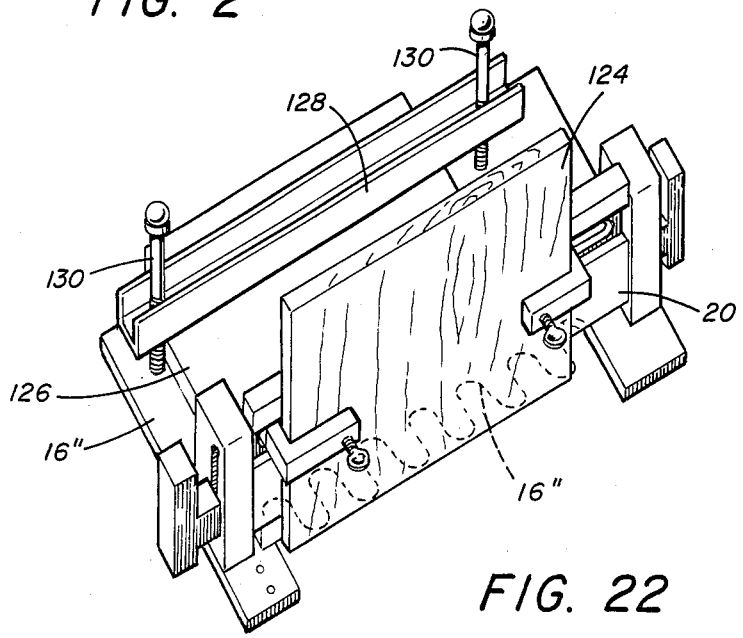
FIG. 22 is a perspective view showing the template of FIG. 21 attached to a fence and having workpieces secured to the fence and to the template.
Figure 23:
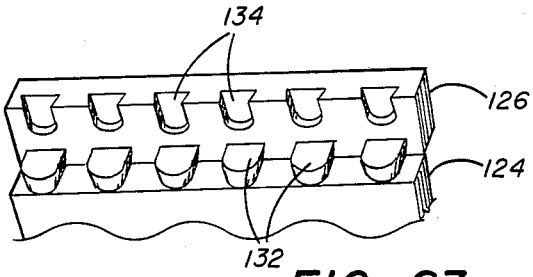
FIG. 23 shows the blind dovetail joint formed by use of the template shown in FIG. 21.

With the workpieces positioned as shown in FIG. 22 and with a conical bit 66 in the router, the unit shown in FIG. 22 is slid over the support platform 12 with the edge pattern 118 of template 16′ in contact with guide bushing 14. As shown in FIG. 21, workpiece 124 is offset by one-half (½) the width of the land on edge pattern 118 from workpiece 126 so that when the cutting is complete, a joint is produced as shown in FIG. 23. A workpiece 124 has the pins 132 formed on it. A workpiece 126 has the grooves 134 formed in it.

In some instances, it may be desirable to have elongated grooves 134 formed in the workpiece. In that fashion, the edge of workpiece 126 could extend out beyond the edge of workpiece 124 to form a rabbitted joint. Edge pattern 120 of template 16″ provides the elongation to the edge pattern which would be required to produce such a rabbeted joint.

It may be seen that I have provided a versatile arrangement of parts which may be sold as a tool kit to those who are interested in woodworking. The tool kit comprises the router support platform 12, the guide bushing 14, the template 16, fence posts 18, fence 20, clamps 22, handles 24, and appropriate cutter bits 64 and 66. Because of the versatility of positioning the guide fence and the angles at which the guide fence may be positioned, a great number of different woodworking joints may be formed. As seen in FIGS. 1–4 and FIG. 12, the slots 50 on the fence posts 18 are off-center so that if the fence posts are turned end to end, the slot is positioned so that it is laterally removed from the position shown in FIGS. 1–4 and FIG. 12. Further the fence 20 may be positioned at an infinite number of angles relative to the template 16 to make various types of joints as shown in FIGS. 12, 14, 15, and 16.

The tool kit of the present invention is particularly safe to use. The router is fixed to the support platform which, in turn, is fixed to a workbench. The entire assembly comprising the template, the workpiece, the fence, the fence posts, and the handles are moved over the router support platform in contact with the guide bushing. Because most routers have adjustable type cutter blades, the joint pattern may be cut in increments by raising the cutter bit of the router incrementally and passing the template and workpiece over the cutter bit more than one time.

In many prior art templates, the template is fixed to the workbench and the hand-held router is passed over the template. This not only makes for inaccuracy in cutting, but presents a more dangerous situation for the operator than the present tool kit.

According to the provisions of the patent statutes, I have explained the principle, preferred construction, and mode of operation of my invention and have illustrated and described what I now consider to represent its best embodiments. However, it should be understood that, within the scope of the appended claims, the invention may be practiced otherwise than as specifically illustrated and described.

I claim:

1. A tool kit for forming various types of joints to connect adjoining wooden members comprising:
   - a horizontally positioned router support platform having a central aperture and means to secure the housing of said router thereto whereby the cutting bit of said router extends upwardly through said central aperture;
   - guide means surrounding said router bit for guiding a template;
   - a template having edge patterns for forming the desired type of joint configuration;
   - fence supporting means securable to said template to support a workpiece fence;
   - a workpiece fence securable to said fence supporting means;
   - clamping means to position and to clamp a workpiece to said fence and said template whereby the portion of said workpiece upon which said joint is to be formed is positioned relative to said template so that said workpiece position, the configuration of said template, and the configuration of said cutting bit control the type of joint formed on said workpiece; and
   - said template, said fence supporting means, said guide fence, and said workpiece being movable as a unit over said router support platform so that said template is guided by said guide means to form the desired joint configurations in said workpiece.

2. The tool kit of claim 1 wherein said guide means is a bushing fixed to said support platform and rotatably receiving said router bit.

3. The tool kit of claim 1, including stop blocks removably securable to said template to locate said workpiece longitudinally along said template.

4. The tool kit of claim 1 wherein said template has edge patterns for forming through dovetail joints.

5. The tool kit of claim 1 wherein said template has edge patterns for forming box joints.

6. The tool kit of claim 1 wherein said template has edge patterns for forming blind dovetail joints.

7. The tool kit of claim 1 wherein said router cutter bit may be incrementally raised relative to said support platform so that thicker workpieces may be subjected to more than one pass over said cutter bit to form said joint.

8. The tool kit of claim 1 wherein said means to secure said router housing to said router support platform, includes a plurality of countersunk slots formed in said support platform to receive router housings of various shapes and sizes by bolting said housings to said platform with bolts having countersunk heads.

9. A woodworking tool kit for forming various types of joints to connect adjoining wooden members comprising:

a router support platform constructed and arranged to be supported in a horizontal positon on a woodworking workbench, said router support platform having a central aperture there through whereby the cutting bit of said router protrudes upwardly through said aperture and means to fix the housing of said router below said support platform;

guide means for said router cutting bit secured to the upper surface of said support platform whereby said router cutting bit rotates relative to said guide means;

a template having edge patterns for forming the desired type of joint configuration;

fence posts removably securable to each end of said template to support a workpiece fence;

a workpiece fence removably securable to said fence posts so that said fence may be positioned at various angles relative to said template, including an angle of 90°;

clamping means to clamp a workpiece to said fence and to said template in a position whereby the portion of said workpiece upon which said joint is to be formed is brought into position on said template so that said workpiece position on said template, the configuration of said template, and the configuration of said cutting bit control the type of joint formed on said workpiece; and handles secured to each of said fence posts whereby said template, said fence posts, and said guide fence with said workpiece attached may be moved as a unit over said router support platform so that said template is guided by said guide means to form the desired joint configurations in said workpiece.

10. The tool kit of claim 9 wherein said fence posts have off-center slots formed therein to facilitate adjustability of said fence angle relative to said template.

11. The tool kit of claim 9 wherein said guide means is a bushing fixed to said support platform and rotatably receiving said router bit.

12. The tool kit of claim 9, including stop blocks removably securable to said template to locate said workpiece longitudinally along said template.

13. The tool kit of claim 9 wherein said template has edge patterns for forming through dovetail joints.

14. The tool kit of claim 9 wherein said template has edge patterns for forming box joints.

15. The tool kit of claim 9 wherein said template has edge patterns for forming blind dovetail joints.

16. The tool kit of claim 9 wherein said router cutter bit may be incrementally raised relative to said support platform so that thicker workpieces may be subjected to more than one pass over said cutter bit to form said joint.

17. The took kit of claim 9 wherein said means to secure said router housing to said router support platform, includes a plurality of countersunk slots formed in said support platform to receive router housings of various shapes and sizes by bolting said housings to said platform with bolts having countersunk heads.

18. The method of forming selected type of joint to connect adjoining wooden members comprising:

fixing a router below a horizontal support platform whereby the cutting bit of said router extends upwardly through an aperture in said platform and through a cylindrical guide means fixed to said platform;

selecting a cutting bit for said router having a configuration compatible with the configuration of said selected type of joint;

selecting a template having edge patterns for forming the selected type of joint configuration;

temporarily fastening a workpiece upon which said selected joint configuration is to be formed to said template;

sliding said template over said support platform with said template edge pattern in contact with said guide means so that said router cutting bit cuts the desired joint configuration into said workpiece; and thereafter removing said workpiece from said template.

19. The method of claim 18 wherein said workpiece is temporarily fastened to said template by fixing a fence to said template and clamping said workpiece to said fence.

20. The method of claim 19 wherein said fence is fixed to said template at an angle appropriate for the selected type of joint.

* * * * *